US005844189A

United States Patent [19]

Niemeyer

[11] Patent Number: 5,844,189

[45] Date of Patent: Dec. 1, 1998

[54] CIRCUIT BREAKER HAVING CONTACTS WITH EROSION-RESISTANT COVERING

[75] Inventor: Lutz Niemeyer, Birr, Switzerland

[73] Assignee: ABB Research Ltd., Zurich, Switzerland

[21] Appl. No.: 621,641

[22] Filed: Mar. 26, 1996

[30] Foreign Application Priority Data

May 13, 1995 [DE] Germany ..... 195 17 615.4

[51] Int. Cl.[6] ..... H01H 9/44; H01H 33/82

[52] U.S. Cl. ..... 218/29; 218/26; 218/43; 218/57

[58] Field of Search ..... 218/26, 29, 43, 218/57, 59, 63, 117

[56] References Cited

U.S. PATENT DOCUMENTS

| | | | |
|---|---|---|---|
| 4,052,577 | 10/1977 | Votta | 200/147 |
| 4,418,255 | 11/1983 | Hess et al. | 200/147 |
| 4,577,074 | 3/1986 | Pham | 200/148 |
| 4,843,199 | 6/1989 | Niemeyer | 200/148 |

FOREIGN PATENT DOCUMENTS

| | | |
|---|---|---|
| 758950 | 4/1952 | Germany . |
| 49131 | 1/1960 | Germany . |
| 1220927 | 7/1966 | Germany . |
| 3041083A1 | 6/1982 | Germany . |
| 2723552C2 | 12/1985 | Germany . |
| 4111932A1 | 10/1992 | Germany . |
| 4212740A1 | 10/1993 | Germany . |
| 4221951A1 | 1/1994 | Germany . |
| 324323 | 9/1957 | Switzerland . |

OTHER PUBLICATIONS

#1277044, Internal Publication, "Schaltstuck mit einer aus einem Graphitkorper bestehenden Lichtbogenelektrode und Verfahren zu dessen Herstellung", Jun. 1975.

*Primary Examiner*—Michael L. Gellner

*Assistant Examiner*—Michael J. Hayes

*Attorney, Agent, or Firm*—Burns, Doane, Swecker & Mathis, L.L.P.

[57] ABSTRACT

A circuit breaker includes a cylindrical arcing chamber filled with an insulating medium. The arcing chamber has a power current path and an insulating housing. The insulating housing has a longitudinal axis and the power current path extends along the longitudinal axis of the insulating housing. The power current path includes a fixed contact arrangement and a contact arrangement. The fixed contact arrangement is attached to an electrically insulating guide part. The contact arrangement has a moving contact cage. The fixed contact arrangement and the contact arrangement have a first and second fixed erosion-resistant covering, respectively. The insulating housing has a blast volume for accumulating an increased pressure of the insulating medium which occurs when the moving contact cage breaks contact with the fixed contact arrangement. When the circuit breaker is in an on position, the contact cage contacts the fixed contact arrangement above the guide part and surrounds the guide part. The insulating housing has a shoulder which projects into a region between the first erosion-resistant covering and the second erosion-resistant covering. The first and second erosion-resistant coverings are arranged concentrically around the guide part and the moving contact cage. When the circuit breaker switches from the on position to an off position, the moving contact cage moves out of contact with the fixed contact arrangement and into contact with the guide part.

14 Claims, 4 Drawing Sheets

CIRCUIT BREAKER HAVING CONTACTS WITH EROSION-RESISTANT COVERING

BACKGROUND OF THE INVENTION

1. Field of the Invention

The invention is based on a circuit breaker.

2. Discussion of Background

Circuit breakers, filled with a gaseous insulant or quenching medium, preferably sulfur hexafluoride, which have an arcing chamber with a power current path and a rated current path are known. As a rule, an arc-quenching zone having an insulant nozzle is provided. The power current path has at least one fixed and one moving contract. The arcing chamber can be designed as a single-blast chamber or as a chamber provided with double blast. In addition, the arcing chamber may be designed as an automatic-blast chamber, in which the energy of the electric arc itself produces the blast pressure required for the quenching, this pressure being accumulated in a blast volume until there is a high probability of being able to blow out the electric arc. A particularly rapid pressure build-up in the blast volume is achieved if the electric arc is displaced in rotation using one of the known measures. In the case of the known circuit breakers, a comparatively high degree of contact erosion occurs.

Patent DE 3 041 083 A1 discloses an arcing chamber arrangement with double blast, which has two fixed, mutually separated, tubularly designed contacts. In the on state, the separation between the two contacts is electrically conductively bridged by a moving contact cage. On breaking, the contact cage slides down from one of the contacts and then induces an electric arc. When the contact cage moves further, this electric arc switches from the contact cage to the second of the fixed contacts, so that the electric arc then discharges between the two fixed contacts. The electric arc is blasted there with pressurized insulant gas, it being possible for the pressure to be produced, for example, by a piston-cylinder arrangement or by the electric arc energy itself. In this arcing chamber arrangement, the electric arc roots migrate into the fixed contacts and the electric arc is then extended so that the energy dissipated in the electric arc increases, which has a detrimental effect on the contact erosion.

SUMMARY OF THE INVENTION

Accordingly, one object of the invention is to provide a novel circuit breaker in which the contact erosion is reduced by simple means.

The advantages afforded by the invention essentially consist in that the electric arc discharges in an annular gap, so that extension of this electric arc is very reliably avoided, with the consequence that the electric arc energy can be limited to controllable values. The volume and also the dimensions of the arcing chamber can therefore advantageously be kept small, so that an advantageously compact and inexpensive circuit breaker is produced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
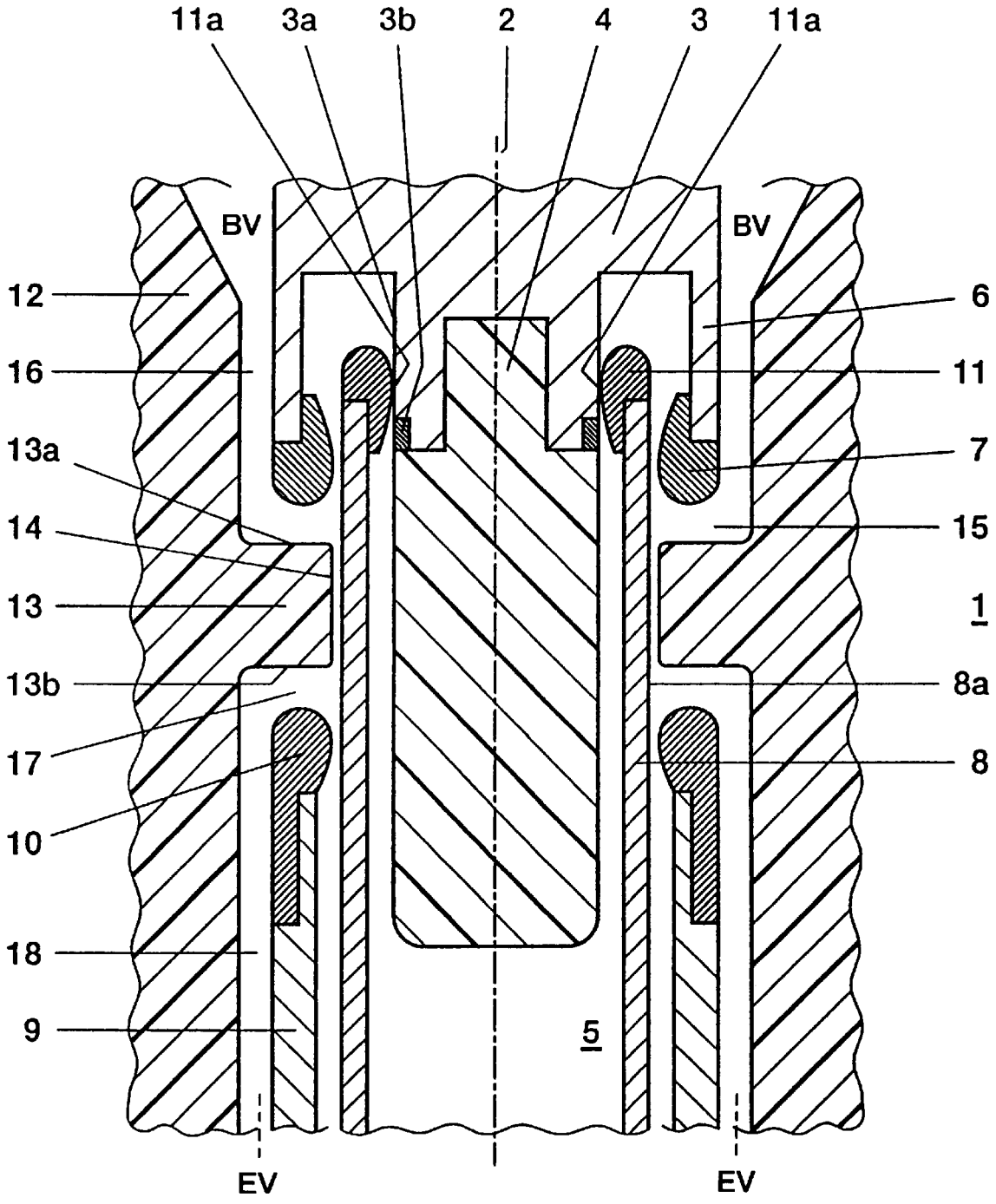
FIG. 1 shows a first, greatly simplified partial section through a first embodiment of a circuit breaker according to the invention, with an arcing chamber which is switched on, FIG. 2 shows a second, greatly simplified partial section through the first embodiment of the circuit breaker according to the invention, with an arcing chamber represented in a first intermediate position during switching off.

Referring now to the drawings, wherein like reference numerals designate identical or corresponding parts throughout the several views, all parts not required for direct understanding of the invention not being represented, FIG. 1 represents a first, greatly simplified partial section through a first embodiment of a circuit breaker according to the invention. This circuit breaker has an arcing chamber 1 filled with an insulating medium, for example sulfur hexafluoride ($SF_6$gas). The arcing chamber 1 has a longitudinal axis 2, about which the arcing-chamber contacts are centrosymmetrically arranged. A fixed contact arrangement 3, made of an electrically conductive metal, is rigidly connected to a centrally arranged, cylindrically designed guide part 4 made of an insulant material. Polytetrafluoroethylene (PTFE) has proved particularly suitable for the production of the guide part 4. Polytetrafluoroethylene (PTFE) can be matched to the respective operating requirements of the circuit breaker with the aid of fillers. If comparatively heavy alternating currents are to be broken, then the guide part 4 is made of particularly erosion-resistant PTFE. It is, however, possible to make the guide part 4 from other insulating materials, which may likewise be filled. The guide part 4 extends up to a contact arrangement 5 and, when the arcing chamber 1 is on, is partly surrounded by the latter. The fixed contact arrangement 3 is provided with an annularly designed erosion contact 6 which is arranged concentrically with the guide part 4. The side of the erosion contact 6 facing the contact arrangement 5 is provided with an annularly designed covering 7 made of an erosion-resistant, electrically conductive material, preferably graphite. The contact arrangement 5 has an inner contact cage 8 which is concentrically surrounded by an outer erosion contact 9. The inner contact cage 8 is actuated in the axial direction by a drive mechanism (not shown). The outer erosion contact 9 is arranged fixed. The inner contact cage 8 and the erosion contact 9 are electrically conductively connected to each other, and are always at the same electrical potential. The side of the fixed erosion contact 9 facing the fixed contact arrangement 3 is provided with an annularly designed covering 10 made of an erosion-resistant, electrically conductive material, preferably graphite. The inner contact cage 8 consists of individual contact fingers which extend parallel to one another. At their tip, each of the contact fingers has an erosion-resistant cap 11 made of electrically conductive material. Tungsten-copper is preferably used for this cap 11. When the arcing chamber 1 is on, these caps 11 have their contact surface 11*a* on a cylindrically designed contact surface 3*a* of the fixed contact arrangement 3, and make electrically conductive contact with this contact surface 3*a*. On the side facing the guide part 4, the contact surface 3*a* may be reinforced by an erosion ring 3*b* made of an erosion-resistant electrically conductive material.

The current path for the alternating current flowing through the closed arcing chamber 1 extends, when comparatively low rated currents are to be throughput, from the fixed contact arrangement 3, into the caps 11, through the contact cage 8 and on through the unrepresented part of the contact arrangement 5. When the arcing chamber 1 is designed for comparatively heavy rated currents, then a separate rated current path is provided in parallel with the described current path, and as a rule generally arranged outside and concentrically with this path.

The above-described current path is enclosed by a housing 12 made of an insulant material. Polytetrafluoroethylene (PTFE) has proved particularly suitable for the production of the housing 12. Polytetrafluoroethylene (PTFE) can be matched to the respective operating requirements of the circuit breaker with the aid of fillers. The housing 12 may also be made of a different electrically insulating plastic, and then be internally provided with a corresponding polytetrafluoroethylene (PTFE) lining. When comparatively heavy alternating currents are to be broken, then the housing 12 is made of particularly erosion-resistant PTFE. It is, however, possible to make the housing 12 from different insulating materials, which can likewise be filled. The housing 12 has a shoulder 13 pointing in the direction of the longitudinal axis 2 and extending in the direction of the longitudinal axis 2. It can also be advantageous to make this shoulder 13 from a particularly erosion-resistant insulant material, the shoulder 13 being, for example, made erosion-resistant by specific doping during the housing production. The shoulder 13 may, for example, be made as a separate ring from a particularly erosion-resistant insulating material, which is then encapsulated in the housing 12. The shoulder 13 protrudes into the space between the two erosion contacts 6 and 9. When the arcing chamber 1 is closed, the inner surface 14 of the shoulder 13 extends comparatively close to the outer surface 8*a* of the contact cage 8, but without touching the latter. The shoulder 13 does not completely fill the space between the two erosion contacts 6 and 9, and an annularly designed space 15, which runs into an annularly designed channel 16, remains between one flank 13*a* of the shoulder 13 and the covering 7. The channel 16 opens into a blast volume BV arranged concentrically with the longitudinal axis 2. A likewise annularly designed space 17 which leads into an annularly designed channel 18, remains between the other flank 13*b* of the shoulder 13 and the covering 10. The channel 18 here extends downward and opens into an exhaust volume EV. The contact cage 8 surrounds the guide part 4.

Figure 2:
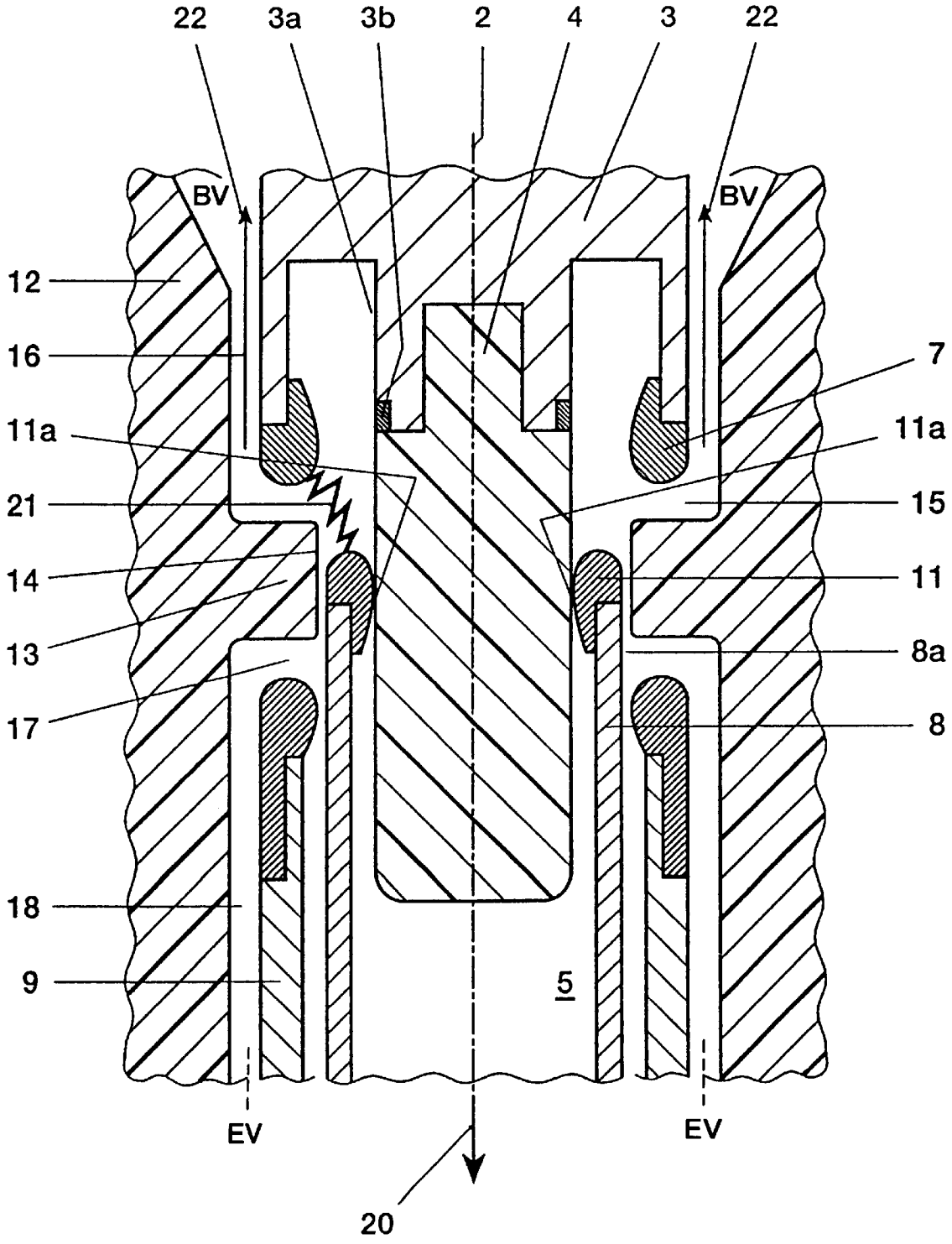

FIG. 2 shows the arcing chamber 1 represented in FIG. 1, in a first intermediate position shortly after the start of the switch off process. An arrow 20 indicates the direction of movement of the contact cage 8 on breaking. The erosion contact 9 provided with the covering 10 does not move with it in this direction. The contact surface 11*a* of the cap 11 of the contact fingers of the contact cage 8 has already slid from the contact surface 3*a*, onto the erosion ring 3*b*, and then onto the immediately adjacent surface of the guide part 4 made of insulating material, a small electric arc having-been produced between the edge of the erosion ring 3*b* facing the guide part 4 and the cap 11. However, this electric arc discharges only briefly onto this edge of the erosion ring 3*b*. As soon as the breaking movement proceeds further, one electric arc root switches from the edge of the erosion ring 3*b* onto the erosion-resistant covering 7 of the erosion contact 6. An electric arc 21 then discharges between this covering 7 and the front edge of the cap 11. This electric arc 21 heats the gas in its vicinity, that is to say in the space 15, and increases its pressure level. The pressurized gas then flows, as indicated by the arrows 22, through the channel 16 into the blast volume BV, where it is accumulated. In this range of the breaking movement, the electric arc 21 cannot engage the contact surface 11*a* of the cap 11, since this contact surface 11*a* rests on the surface of the guide part 4, as a result of which it is protected. The current-carrying capacity of the contact surface 11*a* of the cap 11 consequently remains completely unimpaired.

Figure 3:
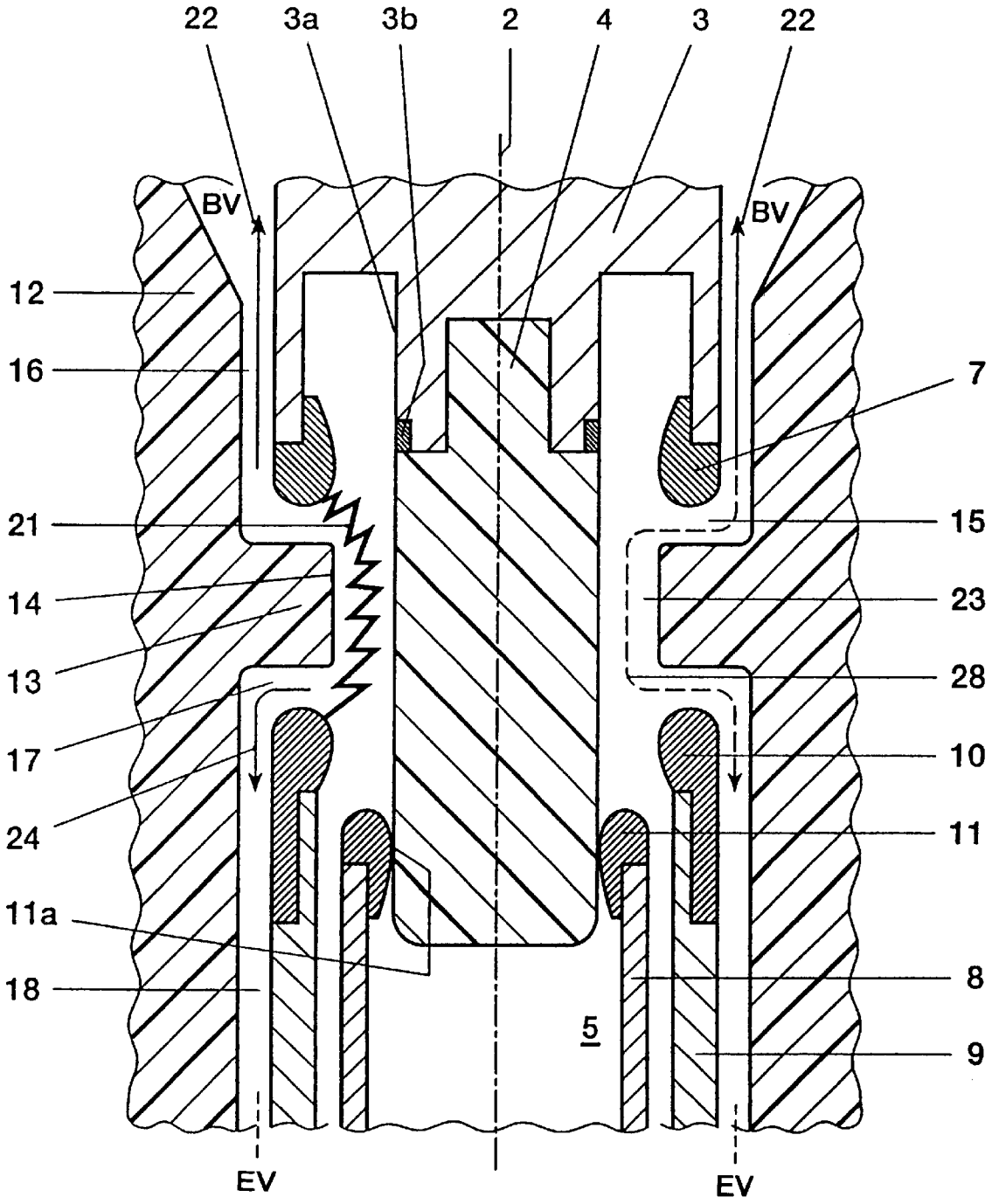
FIG. 3 shows a third, greatly simplified partial section through the first embodiment of the circuit breaker according to the invention, with an arcing chamber represented in a second intermediate position during switching off.

FIG. 3 shows the arcing chamber 1 represented in FIG. 1, in the break position. The contact cage 8 has moved so far in the direction of the arrow 20 that the coverings 7 of the contact fingers of the contact cage 8 now lie inside the fixed erosion contact 9 provided with the covering 10, so that the lower root of the electric arc 21 has switched from the cap 11 onto the covering 10 of the erosion contact 9. The electric arc 21 then discharges, in the annular gap 23 formed between the surface 14 of the shoulder 13 and the surface of the guide part 4, between the covering 7 and the covering 10, so that even in this range of the execution of the breaking movement, the contact surface 11*a* of the cap 11 is reliably protected against detrimental direct effects of the electric arc 21. In this position, the contact cage 8 is dielectrically screened by the fixed erosion contact 9. The annular space 17 is then likewise heated via the electric arc 21, and the pressurized gas produced there flows, as indicated by an arrow 24, out through the channel 18 into an underlying exhaust volume (not shown).

Figure 4:
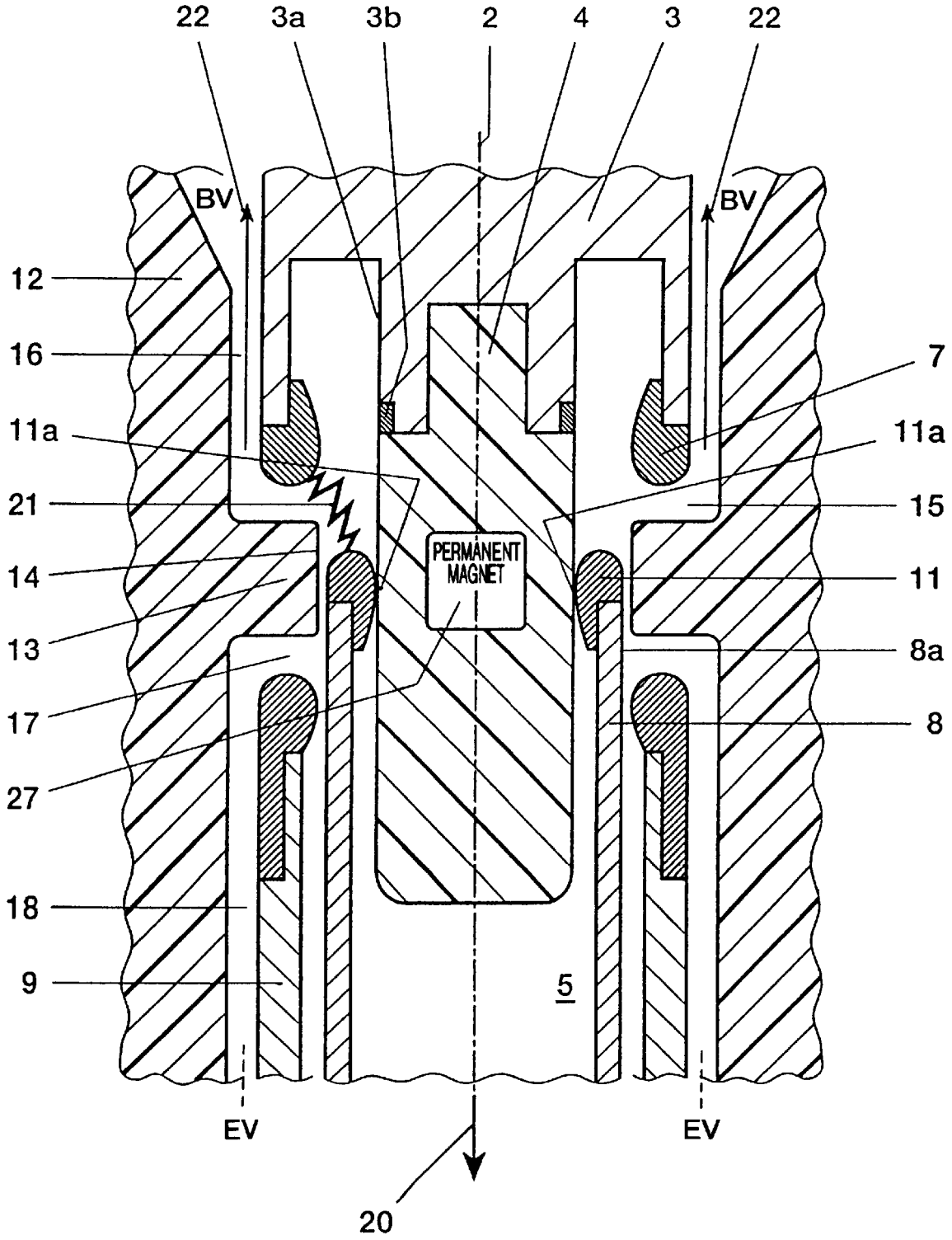
FIG. 4 shows a greatly simplified partial section through a second embodiment of the circuit breaker according to the invention.

A particularly expedient erosion behavior is produced if the electric arc 21 rotates. In order to achieve this rotation, an axial magnetic field, acting on the electric arc 21, is required. This magnetic field can be produced, in known fashion, by expediently arranged magnetic coils or by corresponding permanent magnets. In FIG. 4, by way of example, a permanent magnet 27 is arranged inside the guide part 4, concentrically with the annular gap 23, and produces this magnetic field which acts on the electric arc 21, so that the electric arc 21 rotates around the longitudinal axis 2 in the annular gap 23.

In order to explain the mode of operation, the figures will now be considered in more detail. In FIG. 2, the space 15 is closed downward by the shoulder 13 and the caps 11. The electric arc 21 heats the gas located in the space 15. As indicated by the arrows 22, the heated gas, which is now at a higher pressure level, flows out through the channel 16 into the blast volume, where it is accumulated, until it is required for quenching the electric arc 21. In this position of the contact cage 8, the space 15 has no other significant outflow cross sections, so that virtually all of the pressurized gas flows into the blast volume and this guarantees that, just after the contact separation has been completed, effective pressure production can take place.

The electric arc 21 is quenched when, as represented in FIG. 3, the electric arc 21 discharges between the coverings 7 and 10 in the annular gap 23. The discharge of the electric arc 21 is generally not static, and the electric arc roots change their position continuously, as a result of the Lorentz forces which act, so that the erosion of the coverings 7 and 10 is distributed over their periphery. If the electric arc 21 is then caused to rotate quickly in the annular gap 23 by a magnetic field, then the erosion of the coverings 7 and 10 is further reduced.

The electric arc 21 has a variable intensity, depending on the instantaneous value of the alternating current to be turned off, so that the strength of the pressure production in the space 15 varies. When the electric arc current passes through a zero crossing region, then a lower gas pressure prevails in the space 15 than in the blast volume. This pressure drop between the blast volume and the space 15 causes a flow of the compressed gas out of the blast volume, through the channel 16, into the space 15 and then on through the annular gap 23, the space 17 and the channel 18, into the exhaust volume. In FIG. 3, this gas flow is indicated by a dashed arrow 28. This gas flow cools the electric arc 21 and quenches it at a zero crossing.

For higher operating voltages, the separation between the coverings 7 and 10 may be enlarged, the annular gap 23 being at the same time correspondingly extended in the axial direction.

Obviously, numerous modifications and variants of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit breaker comprising:

a cylindrical arcing chamber filled with an insulating medium, the arcing chamber having a power current path and an insulating housing, the insulating housing having a longitudinal axis and the power current path extending along the longitudinal axis of the insulating housing, the power current path including a fixed contact arrangement, the fixed contact arrangement being attached to an electrically insulating guide part, and a contact arrangement the contact arrangement having a moving contact cage, the fixed contact arrangement and the contact arrangement having a first and second fixed erosion-resistant covering respectively, the insulating housing having a blast volume for accumulating an increased pressure of the insulating medium which occurs when the moving contact cage breaks contact with the fixed contact arrangement, wherein, when the circuit breaker is in an on position, the contact cage contacts the fixed contact arrangement above the guide part and surrounds the guide part, the insulating housing has a shoulder which projects into a region between the first erosion-resistant covering and the second erosion-resistant covering, the first and second erosion-resistant coverings are arranged concentrically around a path of the guide part and the moving contact cage, and, when the circuit breaker switches from the on position to an off position, the moving contact cage moves out of contact with the fixed contact arrangement and into contact with the guide part.

2. The circuit breaker as claimed in claim 1, wherein the guide part and the housing are made from polytetrafluoroethylene (PTFE).

3. The circuit breaker as claimed in claim 1, further comprising means for causing a location of an electric arc between the fixed contact arrangement and the contact arrangement to be rotationally displaced about the longitudinal axis.

4. The circuit breaker as claimed in claim 3, wherein the means for displacing the electric arc is arranged proximate the shoulder.

5. The circuit breaker as claimed in claim 1, wherein a thickness of the shoulder in the direction of the longitudinal axis of the insulating housing and a distance in the direction of the longitudinal axis of the insulating housing between the erosion-resistant coverings correspond to an operating voltage of the circuit breaker.

6. The circuit breaker as claimed in claim 1, wherein the shoulder has a first side and a second side, and first and second annular spaces are provided on the first and second sides of the shoulder, respectively, the first space being connected by a channel to the blast volume, and the second space being connected via at least one connection to an exhaust volume.

7. The circuit breaker as claimed in claim 6, wherein the channel is annular and the at least one connection an annular channel.

8. The circuit breaker as claimed in claim 1, wherein the guide part has a surface the shoulder has a surface, and the surface of the guide bar and the surface of the shoulder are separated by an annular gap.

9. The circuit breaker as claimed in claim 1, wherein at least one of the first and second erosion-resistant coverings is made from graphite.

10. A circuit breaker, comprising:

an insulating housing having a cylindrical opening extending along a longitudinal axis, the insulating housing having a shoulder extending inwardly of the longitudinal opening;

a fixed contact arrangement disposed inside of the cylindrical opening of the insulating housing on a first side of the shoulder, the fixed contact arrangement including a cylindrical center portion and a tubular, erosion-resistant covering portion disposed annularly around the center portion;

an electrically insulating, cylindrical guide part attached to an end of center portion, the guide part extending from the first side of the shoulder to a second side of the shoulder and defining, with the shoulder, an annular gap;

a movable contact arrangement disposed inside of the cylindrical opening of the insulating housing, the movable contact arrangement including a movable contact cage and a second tubular, erosion-resistant covering portion disposed annularly around the contact cage, the second covering portion being disposed on the second side of the shoulder, and the contact cage being movable between a first position wherein a first end of the contact cage is disposed on the first side of the shoulder in contact with and circumferentially around the center portion and a second position wherein the first end of the contact cage is disposed on the second side of the shoulder below a first end of the second covering portion and in contact with and circumferentially around the guide part.

11. The circuit breaker as claimed in claim 10, further comprising means for causing a location of an electric arc between the fixed contact arrangement and the movable contact arrangement to be rotationally displaced about the longitudinal axis.

12. The circuit breaker as claimed in claim 11, wherein the means for displacing the electric arc is arranged proximate the shoulder.

13. The circuit breaker as claimed in claim 10, wherein the guide part and the housing are mode from polytetrafluoroethylene (PTFE).

14. The circuit breaker as claimed in claim 10, wherein at least one of the first and second erosion resistant coverings is made from graphite.

* * * * *